US005275081A

United States Patent [19]

Freer

[11] Patent Number: 5,275,081

[45] Date of Patent: Jan. 4, 1994

[54] SNARE CLAMP FOR A DRUM

[76] Inventor: Thomas C. Freer, 3822 Delmore, Cleveland Heights, Ohio 44121

[21] Appl. No.: 912,123

[22] Filed: Jul. 9, 1992

[51] Int. Cl.[5] ..... G10D 13/02

[52] U.S. Cl. ..... 84/415

[58] Field of Search ..... 84/411

[56] References Cited

U.S. PATENT DOCUMENTS 365,817 7/1887 Johnson .
1,595,764 8/1926 Elliott .
2,261,120 11/1941 Ludwig et al. .
4,339,982 7/1982 Noshino ..... 84/415
5,107,742 4/1992 Cummings et al. ..... 84/415

*Primary Examiner*—Michael L. Gellner
*Assistant Examiner*—Pat Stanzione
*Attorney, Agent, or Firm*—Barnes & Thornburg

[57] ABSTRACT

A snare clamp assembly that provides multiple independently adjustable elements for adjustment of a portion of the snares without affecting the adjustment of the remaining snares. This clamp assembly includes a primary element, a secondary element that is adjustably coupled to the primary element, and a tertiary element adjustably coupled to the secondary element.

25 Claims, 2 Drawing Sheets

SNARE CLAMP FOR A DRUM

BACKGROUND AND SUMMARY OF THE INVENTION

The present invention relates to snare drums, and particularly to a mechanism for attaching snares to a tensioning device on the drum. More particularly, the invention relates to a mechanism for individually adjusting the snares on a drum and for precisely setting a tilt angle of the adjusting mechanism relative to the snares.

Snare drums produce a sound that is different from all other drums. This unique sound is produced by stretching snares, typically made of cable, gut, or wire, across one head of a drum. These snares are generally attached to the drum shell at one end, stretched across a snare head, and attached to a strainer which is attached to the opposite side of the drum shell. The strainer operates to stretch the snare across the drum head, or to release the tension and allow the snares to move away from the drum head.

By varying the amount of tension that the strainer applies to snares, a drummer can change the sound produced by the snare drum. Since the strainer only applies and releases tension to the snares, but does not adjust the tension, another means for adjusting the tension is needed. Mechanisms for adjusting the tension of the snares are known. See for example, U.S. Pat. No. 1,595,764 to Elliott; U.S. Pat. No. 2,261,120 to Ludwig et al.; and, U.S. Pat. No. 365,187 to Johnson.

Various clamping mechanisms have been devised for attaching the snares to the strainer and adjusting the tension of the snares. However, at times, it is also desirable to change the orientation of the clamping mechanism relative to the snares as a means of further adjusting the sound to achieve a desired result. A mechanism that would allow a snare drummer to precisely adjust the angle of the clamping mechanism relative to the snares would provide an improvement over conventional clamping mechanisms. Some conventional clamping mechanisms allow tilt angle adjustment, but repeated cycles of the strainer disrupt the tilt angle, causing it to change little by little over a number of cycles. As a result, it is difficult to get consistent results. A greater improvement would provide a mechanism that allows repeated cycling of the strainer between tightening and loosening of the snares without disrupting the angle of the clamp relative to the snares. Such an improvement would allow consistent results over repeated cycles of the strainer.

According to the present invention, a snare clamp includes a primary element and a secondary element adjustably coupled to the primary element, and at least one tertiary element adjustably coupled to the secondary element. The clamp further includes means for attaching the primary element to the strainer.

In some embodiments, a first group of snares is positioned between the primary and secondary elements which cooperate to form a first vise for gripping the first group of snares. A second group of snares is positioned between the secondary element and the tertiary element, the elements cooperating to form a second vise for gripping the second group of snares. The second group of snares may be divided into sub-groups of snares which can be individually adjusted when more than one tertiary element is provided.

In other embodiments, the means for attaching the snare clamp to the strainer includes means for precisely adjusting the tilt angle of the snare clamp. The means for precisely adjusting the tilt angle includes cylindrical cable-receiving bores formed in one of the elements. The adjusting means also includes connecting cables passing through the cable-receiving bores, the connecting cables being attached to the strainer. According to one aspect of the invention, the cable-receiving bores are formed in the primary element and each cable passes through a plurality of cable-receiving bores.

By providing a snare clamp with multiple independently adjustable elements, the present invention allows the adjustment of a portion of the snares without affecting the adjustment of the remaining snares. By further providing cylindrical cable-receiving bores and a plurality of connecting cables attached to the strainer, the present invention also allows for precise adjustment of the tilt angle of the snare clamp relative to the snares. The plurality of connecting cables cooperating with the plurality of cable-receiving bores allows for repeated strainer cycles of tensioning and loosening the snares without affecting the adjustment of the tilt angle of the snare clamp relative to the snares, thereby providing a substantial improvement over conventional snare clamps.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
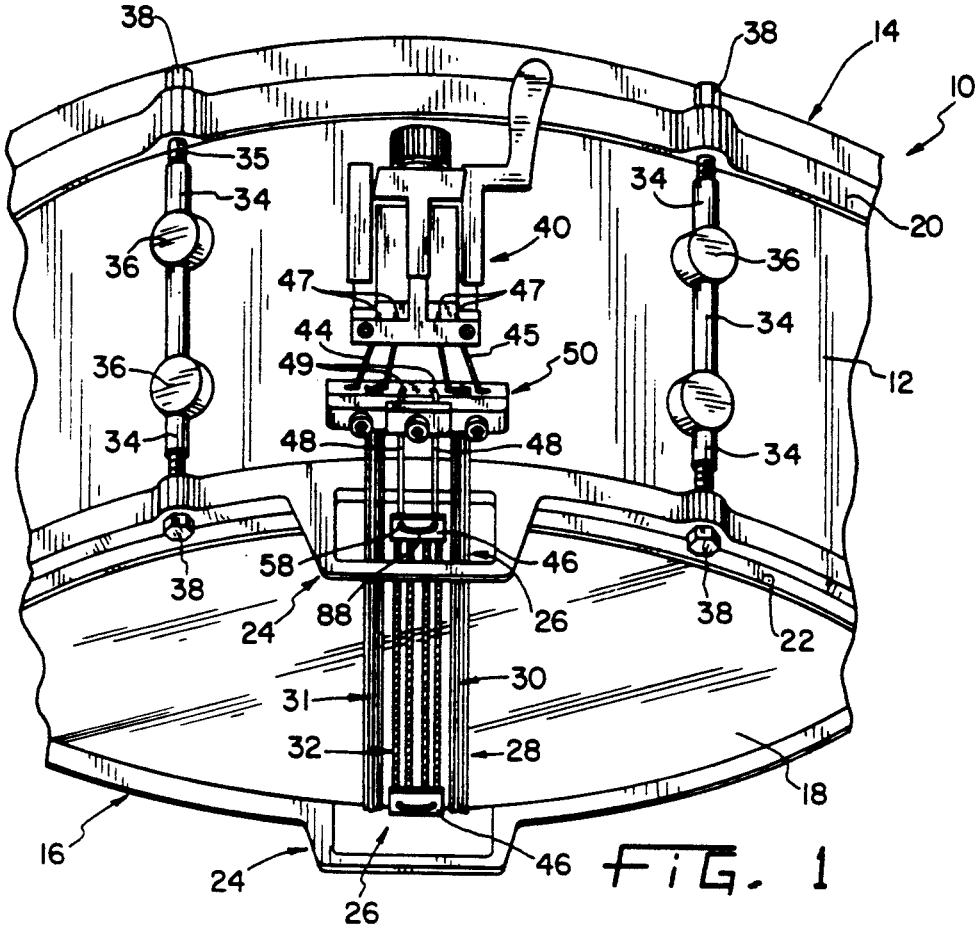
FIG. 1 is a perspective view of a portion of a snare drum showing snares attached to a clamp made according to the present invention, the clamp, in turn, being connected to a strainer.

A snare drum 10 shown in FIG. 1, includes shell 12 having batter end 14 and snare end 16. A batter head (not shown) is attached to batter end 14 by batter rim 20. Snare head 18 is attached to snare end 16 by snare rim 22. Batter rim 20 and snare rim 22 are pulled together by tension rods 24. Tension rods 24 are aligned and held in place by passing through lugs 36 which are attached to shell 12. Rims 20 and 22 are positioned over their respective ends 14 and 16 so that tension rods 24 align with tension rod-receiving apertures 35 formed in rims 20 and 22. Tension rods 34 pass through apertures 35. Nuts 38 threadingly engage tension rods 34 pulling rims 20 and 22 together, thereby fastening the batter head (not shown) and snare head 18 to batter end 14 and snare end 16, respectively. Snare rim 22 is formed to include snare gate 24 having aperture 26 through which snares 28 can pass.

Snare drum 10 also has strainer 40 for applying strain or tension to snares 28, or releasing tension and allowing snares 28 to fall away from snare head 18. Snares 28 are attached to an improved, multi-element clamp 50 which in turn is attached to strainer 40 by connecting cables 44.

Figure 2:
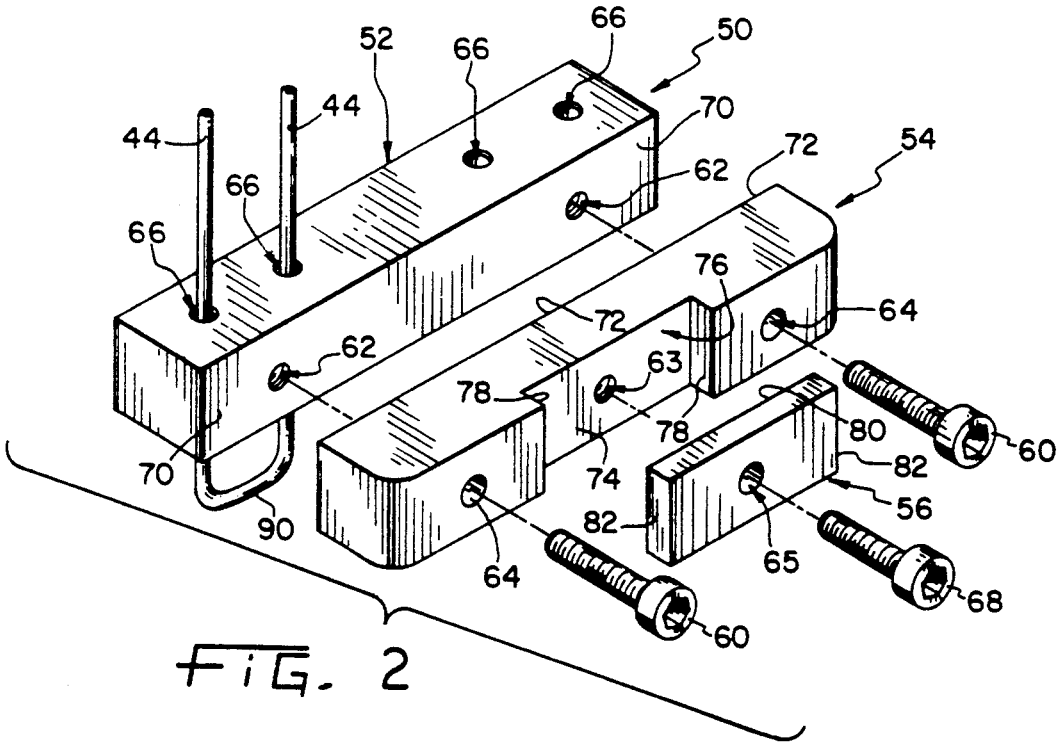
FIG. 2 is an exploded view of an embodiment of a snare clamp accordingly to the present invention.

With reference to FIG. 2, multi-element clamp 50 includes primary element 52, secondary element 54, and tertiary element 56. Primary element 52 has first gripping surface 70. Threaded apertures 62 are formed in primary element 52 so as to be orthogonal to first gripping surface 70. Cable-receiving apertures 66 are formed to pass through primary element 52. Apertures 66 are orthogonal to threaded apertures 62 and separate therefrom.

Secondary element 54 is formed to have second gripping surface 72 and third gripping surface 74. Second gripping surface 72 is positioned to operably abut first gripping surface 70 of primary element 52. Smooth bore apertures 64 are formed in secondary element 54, and positioned to coaxially align with threaded apertures 64 formed in primary element 52. Secondary element 54 is also formed to include channel 76 for receiving tertiary element 56. Channel 76 is defined by third gripping surface 74 and channel side walls 78. Threaded aperture 63 is formed in the center of third gripping surface 74 and orthogonal thereto.

Tertiary element 56 has fourth gripping surface 80 that abuts third gripping surface 74 formed on secondary element 54. Side walls 82 formed on tertiary element 56 operably abut the channel side walls 78. Smooth bore aperture 65 is formed in the center of tertiary element 56 to coaxially align with threaded aperture 62 formed in secondary element 54.

Allen bolts 60 are coaxially aligned with smooth bore apertures 64 formed in secondary element 54. Passing through apertures 64, allen bolts 60 threadingly engage threaded apertures 62 formed in primary element 52. With allen bolts 60 operably positioned, gripping surfaces 70 and 72 are aligned to operably abut each other.

Allen bolt 68 is coaxially aligned with smooth bore aperture 64 formed in tertiary element 56. Passing through aperture 64, allen bolt 68 threadingly engages threaded aperture 62 formed in secondary element 54. With allen bolt 68 operably positioned, gripping surfaces 74 and 80 are aligned to abut each other, and side walls 82 operably abut channel side walls 78.

In a preferred embodiment, snares 28 are divided into three groups, inner group 32 and outer groups 30 and 31. Outer snare groups 30 and 31 are gripped between gripping surfaces 70 and 72 of primary and second elements 52 and 54, respectively. Allen bolts 60 threadingly engage apertures 62 to press primary and secondary elements 52 and 54 together at the gripping surfaces 70 and 72, thereby forming a vise to grip snare groups 30 and 31. This method of attaching outer snare groups 30 and 31 to clamp 50, as presently conceived, is a semi-permanent attachment. However, allen bolts 60 can be loosened to allow snare groups 30 and 31 to be adjusted, and allen bolts 60 can then be retightened.

Inner snares 32 are attached to snare clasp 46. Ends 49 of secondary connecting cable 48 pass through apertures 58 formed in snare clasp 46, thereby positioning snare clasps 46 in the bight 88 of secondary connecting cable 48. Ends 49 of secondary connecting cable 48 are positioned between gripping surfaces 74 and 80 of secondary element 54 and tertiary element 82, respectively. Allen bolt 68 threadingly engages threaded aperture 62 formed in secondary element 54, thereby causing pressing secondary and tertiary elements 52 and 54 together at gripping surfaces 74 and 80 to grip ends 49 of secondary connecting cable 48. By loosening allen bolt 68, ends 49 of secondary connecting cable 48 can be pulled toward strainer 40 or allow to move away from strainer 40, thereby increasing or decreasing, respectively, the tension on inner snares 32. Advantageously, the design of the present invention allows adjustment of inner snares 32 without loosening allen bolts 60. In this manner, the adjustment of outer groups 30 and 31 remains unchanged while the tension on inner snares 32 is adjusted, because primary element 52 and secondary element 54 are not moved relative to each other by any adjustment using allen bolt 68.

Clamp 50 is attached to strainer 40 by connecting cables 44 and 45. Each connecting cable 44 and 45 passes through adjacent cable-receiving apertures 66, so that the bight 90 of cables 44 and 45 lies adjacent primary element 52 and between adjacent cable-receiving apertures 66. Ends 47 of cables 44 and 45 are attached to T-bar clamp 42 attached to strainer 40. By adjusting the relative amounts of cable 44 and 45 between T-bar 42 and clamp 50, the tilt angle of clamp 50 relative to snares 28 can be precisely set. Advantageously, since ends 47 of cables 44 and 45 are firmly attached to T-bar 42 and are not allowed to vary, the tilt angle of clamp 50 relative to snares 28 remains unchanged, regardless of the number of cycles of strainer 40 between applying and relaxing tension to snares 28.

Figure 3:
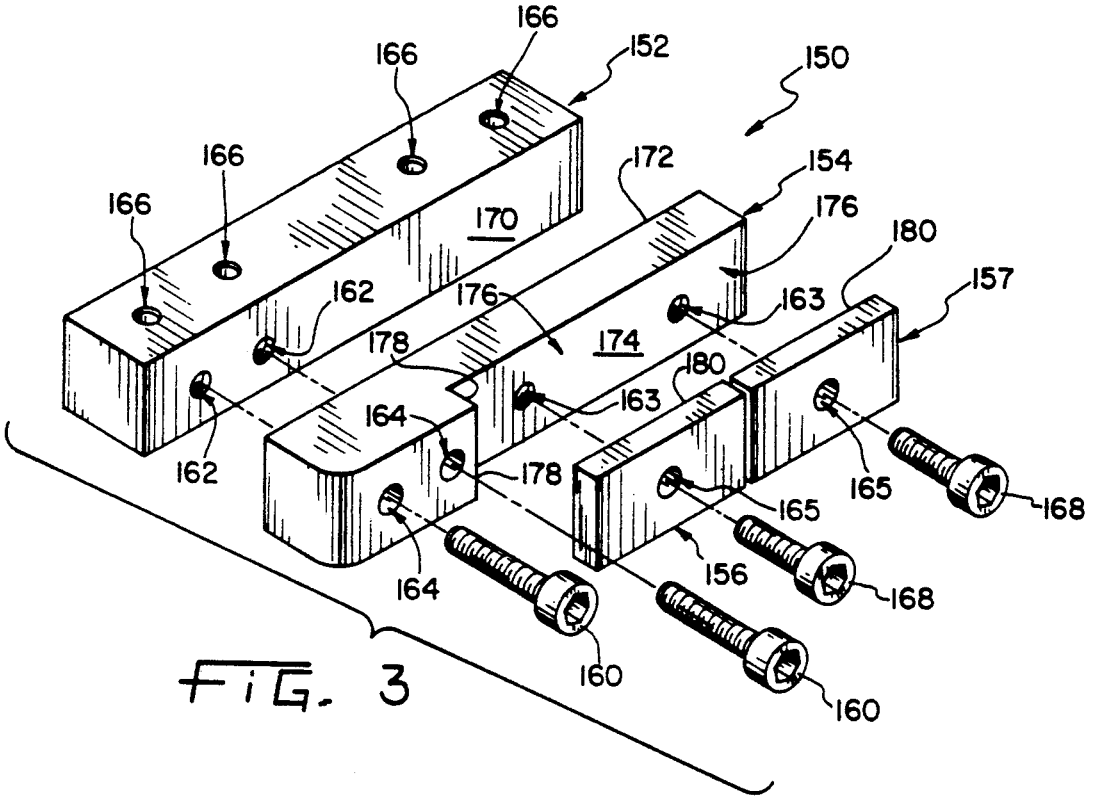
FIG. 3 is an exploded view of an alternative embodiment of snare clamp.

In an alternative embodiment, as shown in FIG. 3, clamp 150 comprises primary element 152, secondary element 154, and tertiary elements 156 and 157. Primary element 152 has first gripping surface 170. Threaded apertures 162 are formed to be orthogonal to gripping surface 170. Cable-receiving apertures 166 are orthogonal to threaded apertures 162, but separate therefrom.

Secondary element 154 includes second gripping surface 172 and third gripping surface 174. Gripping surfaces 170 and 172 are formed to abut each other. Smooth bore apertures 164 are formed in secondary element 154 so as to coaxially align with threaded apertures 162 formed in primary element 152. Secondary element 154 is also formed to include channel 176 for receiving tertiary elements 156 and 157. Channel 176 is defined by third gripping surface 174 and channel side wall 178. Threaded apertures 163 are formed to be orthogonal to the third gripping surface 174.

Tertiary elements 156 and 157 include fourth gripping surfaces 180 that are formed to abut third gripping surface 174 on secondary element 154. Smooth bore apertures 165 formed in tertiary elements 156 and 157 align coaxially with threaded aperture 163 formed in secondary element 154.

In operation, the snares can be divided into three sub-groups. A first sub-group of snares can be positioned between gripping surfaces 170 and 172, while the second and third sub-groups can be positioned between the secondary element 154 and tertiary elements 156 and 157, respectively. Allen bolts 160 pass through smooth bore apertures 164 formed in secondary element 154 and threadingly engage threaded apertures 162 formed in primary element 152, thereby pressing primary and secondary elements 152 and 154 together to grip the first sub-group of snares therebetween. Allen bolts 168 pass through smooth bore apertures 165 formed in tertiary elements 156 and 157 and threadingly engage threaded apertures 163 formed in secondary element 154.

For use with the alternative embodiment, each of the second and third sub-groups is attached to a snare clasp 46. Ends 49 of secondary connecting cables 48 pass through apertures 58 formed in snare clasps 46, thereby positioning snare clasps 46 in the bights 88 of secondary connecting cables 48. Ends 49 of secondary connecting cables 48 are positioned between gripping surfaces 174 and 180 of secondary element 154 and tertiary elements 156 and 157, respectively. Allen bolts 168 threadingly engage threaded apertures 163 formed in secondary element 154, thereby pressing secondary 154 and tertiary elements 156 and 157 together at gripping surfaces 174 and 180 to grip ends 49 of secondary connecting cables 48. By loosening allen bolts 168, ends 49 of secondary connecting cables 48 can be pulled toward strainer 40 or allowed to move away from strainer 40, thereby increasing or decreasing, respectively, the tension on the second and third sub-groups of snares.

Figure 4:
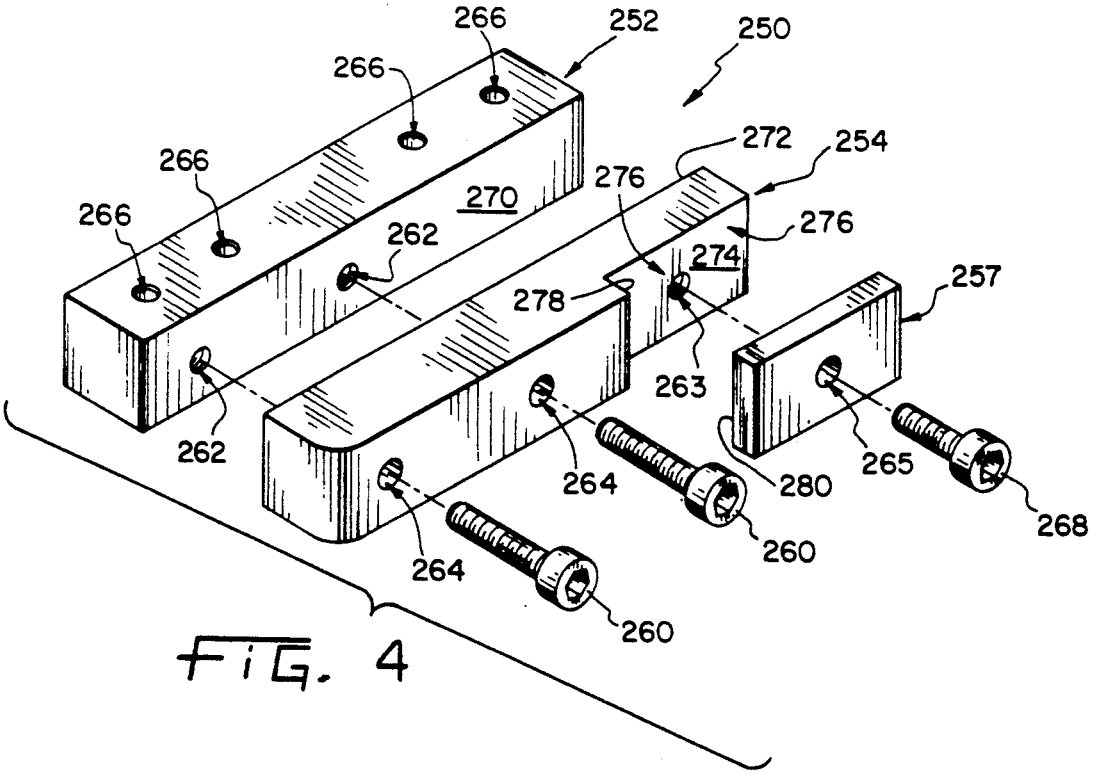
FIG. 4 is an exploded view of another alternative embodiment of a snare clamp.

In another alternative embodiment, as shown in FIG. 4, clamp 250 comprises primary element 252, secondary element 254, and tertiary element 257. Primary element 252 has first gripping surface 270. Threaded apertures 262 are formed to be orthogonal to gripping surface 270. Cable-receiving apertures 266 are orthogonal to threaded apertures 262, but separate therefrom.

Secondary element 254 includes second gripping surface 272 and third gripping surface 274. Gripping surfaces 270 and 272 are formed to abut each other. Smooth bore apertures 264 are formed in secondary element 254 so as to coaxially align with threaded apertures 262 formed in primary element 252. Secondary element 254 is also formed to include channel 276 for receiving tertiary element 257. Channel 276 is defined by third gripping surface 274 and channel side wall 278. Threaded aperture 263 is formed to be orthogonal to the third gripping surface 274.

Tertiary element 257 includes fourth gripping surface 280 that is formed to abut third gripping surface 274 on secondary element 254. Smooth bore aperture 265 is formed in tertiary element 257 to align coaxially with threaded aperture 264 formed in secondary element 254.

In operation, the snares can be divided in two sub-groups. A first sub-group of snares can be positioned between gripping surfaces 270 and 272, while the second sub-group can be positioned between the secondary element 254 and tertiary element 257. Allen bolts 260 pass through smooth bore apertures 264 formed in secondary element 254 and threadingly engage threaded apertures 262 formed in primary element 254, thereby pressing primary and secondary elements 252 and 254 together to grip the first sub-group of snares therebetween. Allen bolt 268 passes through smooth bore aperture 265 formed in tertiary element 257 and threadingly engages threaded aperture 263 formed in secondary element 254.

The second sub-group of snares is attached to a snare clasp 46. Ends 49 of secondary connecting cables 48 pass through apertures 58 formed in snare clasp 46, thereby positioning snare clasp 46 in the bights 88 of secondary connecting cable 48. Ends 49 of secondary connecting cable 48 are positioned between gripping surfaces 274 and 280 of secondary element 254 and tertiary element 257, respectively. Allen bolt 268 threadingly engages threaded aperture 263 formed in secondary element 254, thereby pressing secondary element 254 and tertiary element 257 together at gripping surfaces 274 and 280 to grip ends 49 of secondary connecting cable 48. By loosening allen bolt 268, ends 49 of secondary connecting cable can be pulled toward strainer 40 or allowed to move away from strainer 40, thereby increasing or decreasing, respectively, the tension on the second sub-group of snares.

Advantageously, the design of the present invention allows individual adjustment of sub-groups of snares without affecting the adjustment of the remaining sub-groups.

Clamp 50, 150, 250 is attached to strainer 40 by connecting cables 44 and 45. Each connecting cable 44 and 45 passes through two adjacent cable-receiving apertures 66, 166, 266, so that the bight 90 of cables 44 and 45 lies adjacent to primary element 52, 152, 252 and between adjacent cable-receiving apertures 66, 166, 266. Ends 47 of cables 44 and 45 are attached to T-bar clamp 42. By adjusting the relative amounts of cable 44 and 45 between T-bar 42 and clamp 50, 150, 250, the tilt angle of clamp 50, 150, 250, relative to snares 28 can be precisely set.

Although the invention has been described in detail with reference to a certain preferred embodiment, variations and modifications exist within the scope and spirit of the invention as described and defined in the following claims.

I claim:

1. A snare drum comprising:

a shell having a first end and a second end, a batter head attached to the first end and a snare head attached to the second end, a plurality of snares disposed adjacent the snare head, means attached to the shell for tensioning the snares, and means for attaching the snares to the tensioning means, comprising a primary element and a secondary element adjustably coupled to the primary element for gripping a first sub-group of the plurality of snares and at least one tertiary element adjustably coupled to the secondary element for gripping a second sub-group of the plurality of snares.

2. The snare drum of claim 1, wherein the tension in the first and second sub-groups of the plurality of snares can be adjusted independently.

3. The snare drum of claim 2, wherein the means for attaching the snares to the tensioning means comprises at least two tertiary elements and the second sub-group of snares comprises a plurality of sub-sets of snares and the secondary element and the at least two tertiary elements further comprise means for selectively adjusting snares so that each sub-set of the second sub-group of snares can be individually adjusted.

4. The snare drum of claim 2, wherein the secondary element is formed to include a channel, and the at least one tertiary element operably lies within the channel.

5. The snare drum of claim 4, wherein the channel is formed in the center of the secondary element.

6. The snare drum of claim 4, wherein the channel is formed at an end of the secondary element.

7. The snare drum of claim 1, wherein the attaching means further comprises means for adjusting a tilt angle of the elements.

8. The snare drum of claim 7, wherein the means for adjusting further comprises a plurality of cable-receiving bores formed in one of the elements and a plurality of connecting cables attached to the tensioning means, with each of the plurality of connecting cables passing through a plurality of cable-receiving bores.

9. A snare clamp in combination with a snare drum having snares and a strainer, the clamp comprising:

a primary element, a secondary element adjustably coupled to the primary element for cooperating with the primary element to grip a first sub-group of snares, at least one tertiary element adjustably coupled to the secondary element for cooperating with the secondary element to grip a second sub-group of snares, and means for attaching the primary element to the strainer.

10. The clamp of claim 9, wherein the primary and secondary elements have gripping surfaces and the first sub-group of snares is positioned therebetween and the secondary and at least one tertiary elements have gripping surfaces and the second sub-group of snares is positioned therebetween.

11. The clamp of claim 9, further comprising at least two tertiary elements and the second sub-group of snares comprises a plurality of sub-sets of snares and the secondary element and the at least two tertiary elements further comprise means for selectively adjusting snares so that each sub-set of the second sub-group of snares can be individually adjusted.

12. The clamp of claim 11, wherein the secondary and the at least two tertiary elements have facing gripping surfaces and the sub-sets of the second sub-group of snares are positioned therebetween

13. The clamp of claim 9, wherein the means for attaching the primary element to the strainer includes means for adjusting a tilt angle of the snare clamp.

14. The clamp of claim 13, wherein the means for attaching comprises a plurality of cylindrical cable-receiving bores formed in the primary element and a plurality of connecting cables passing through the cable-receiving bores.

15. The clamp of claim 14, wherein each connecting cable passes through a plurality of cable-receiving bores and is attached to the strainer.

16. In a snare drum having a shell with a batter end, a snare end, a batter head attached to the batter end, a snare head attached to the snare end, a plurality of snares disposed adjacent the snare head, a strainer attached to the shell, the improvement comprising and a clamp for attaching the snares to the strainer, the clamp comprising:

a primary element, a secondary element removably coupled to the primary element for gripping a first group of the plurality of snares, and one tertiary element removably coupled at least one tertiary element removably coupled to the secondary element for gripping a second group of the plurality of snares.

17. The clamp of claim 16, further comprising means for adjusting a tilt angle of the clamp.

18. The clamp of claim 17, wherein the adjusting means comprises cylindrical bores formed in the clamp and connecting cables attached to the strainer and passing through the cylindrical bores.

19. The clamp of claim 16, wherein the primary and secondary elements cooperate to form a first vice for holding the first group of snares and the secondary element and the at least one tertiary element cooperate to form a second vice for holding the second group of snares.

20. The clamp of claim 19, wherein the second group of snares comprises a plurality of sub-groups of snares and the secondary element and the at least one tertiary element further comprise means for selectively adjusting snares so that each sub-group of the second group of snares can be individually adjusted without affecting the adjustment of the other sub-groups of snares.

21. A snare drum comprising:

a shell having a batter end and a snare end, a batter head attached to the batter end and a snare head attached to the snare end, a plurality of snares disposed adjacent to the snare head, a strainer attached to the shell, means for attaching the snares to the strainer, and means for adjusting a tilt angle of the attaching means, the adjusting means comprising a plurality of connecting cables and a plurality of cable-receiving cylindrical bores for each connecting cable.

22. The drum of claim 21, wherein the attaching means further comprises a clamp and the cylindrical bores are formed in the clamp and the cables pass through the plurality of cylindrical bores and are attached to the strainer.

23. The drum of claim 22, wherein the clamp comprises a primary element, a secondary element removably coupled to the primary element for gripping a first group of the plurality of snares, and at least one tertiary element removably coupled to the secondary element for gripping a second group of the plurality of snares.

24. The drum of claim 22, wherein the secondary element is formed to include a channel in the middle thereof and the at least one tertiary element operably fits in the channel.

25. The drum of claim 22, wherein the secondary element includes a channel formed at one end thereof and the at least on tertiary element operably fits in the channel.

* * * * *